US005680725A

United States Patent [19]

Bell

[11] Patent Number: 5,680,725

[45] Date of Patent: Oct. 28, 1997

[54] POSITIVE-ALIGNING QUICK MOUNT

[75] Inventor: Dennis L. Bell, Greeley, Colo.

[73] Assignee: Burris Company, Inc., Greeley, Colo.

[21] Appl. No.: 775,870

[22] Filed: Jan. 2, 1997

[51] Int. Cl.[6] ..... F41G 1/38

[52] U.S. Cl. ..... 42/101; 33/250

[58] Field of Search ..... 42/101; 33/245, 33/250, 248

[56] References Cited

U.S. PATENT DOCUMENTS

| | | | |
|---|---|---|---|
| 1,837,290 | 12/1931 | Redfield | 42/101 X |
| 2,641,057 | 6/1953 | Moore | 33/250 |
| 3,750,318 | 8/1973 | Burris | 42/101 |
| 4,310,980 | 1/1982 | Pilkington | 42/101 |
| 4,835,895 | 6/1989 | Bowen | 42/101 |
| 5,046,277 | 9/1991 | Sanders | 42/101 |
| 5,086,566 | 2/1992 | Klumpp | 42/101 X |
| 5,155,915 | 10/1992 | Repa | 33/250 X |

*Primary Examiner*—Michael J. Carone
*Assistant Examiner*—Matthew J. Lattig
*Attorney, Agent, or Firm*—Michael A. Capraro

[57] ABSTRACT

A positive-aligning quick mount for mounting a sighting scope on a firearm is comprised of a base removably attached to the receiver of a firearm, lower securing means removably attached to the base and upper securing means removably attached to the lower securing means. The upper securing means and the lower securing means encompass and secure a prior art sighting scope in the positive-aligning quick mount. An engaging means is pivotally attached to a side of the lower securing means in an engaging means receptacle, the engaging means and the lower securing means removably engaging the base. The lower securing means is quickly and securely locked on the base and quickly unlocked from the base by rotatable locking means.

21 Claims, 4 Drawing Sheets

POSITIVE-ALIGNING QUICK MOUNT

BACKGROUND OF THE INVENTION

This invention relates generally to a quick mount device and more specifically to a new and novel positive-aligning quick mount. The new and novel positive-aligning quick mount is designed to be used with a variety of sighting scopes used on prior art firearms such as rifles, shotguns, black-powder weapons and handguns. The new and novel positive-aligning quick mount is further designed to allow quick and easy mounting, removal and re-mounting of sighting scopes on prior art firearms without the need to re-adjust or zero the scope.

On prior art firearms, such as rifles, shotguns, black-powder weapons and handguns, there are spaced apart attachment points, typically found in the top surface of the receiver, used for attaching a device in which a sighting scope is mounted. Scope mounting devices position the sighting scope above the barrel of the firearm and align the sighting scope with the barrel of the firearm. The scope is then sighted, or adjusted for windage and elevational, providing an accurate and positive point of aim.

While there are a wide variety of scope mounting devices, and variations of scope mounting devices, design problems in prior art scope mounting devices present several disadvantages. Prior art mounting devices typically encompass and hold a sighting scope in a scope holding portion which is then attached to a base on the receiver of a firearm. These types of mounting devices generally clasp either side of the base and are locked in position on the base using a variety of screw fasteners requiring the use of a tool, such as a screwdriver, to firmly seat the scope holding portion on the base or to remove the scope holding portion from the base. Thus, it is often difficult and time consuming to attach or remove the scope from the base.

More importantly, these types of prior art mounting devices simply squeeze the base, thereby providing only one contact point on each side of the base. That is, there is one point of contact by the scope holding portion on one side of the base, and one point of contact by the scope holding portion on the other side of the base. If the scope holding portion of the mounting device is removed from the base, for example to repair or clean the firearm or to store the scope, this two contact point configuration will mis-align the scope when the scope holding portion is replaced on the base requiring the scope to be re-sighted or re-zeroed. That is, the scope holding portion of prior art mounting devices cannot be re-mounted in exactly the same original position on the base before its removal. A one-thousandths of an inch variance in the re-mounted position of the scope holding portion on the base causes a one inch shift in the point of aim at one hundred yards. Thus, the scope must be re-sighted or re-zeroed. The two contact point configuration is also susceptible to mis-alignment when the scope is subjected to intense recoil or when the firearm on which the scope is mounted is jarred or dropped. Poor machining tolerances and molding techniques often amplify this problem.

Some prior art mounting devices attempt to overcome this problem by including a bar or rod, located in the bottom of the scope holding portion of the mounting device, that fits into a groove or channel in the surface of the base. However, differences in base manufacture, machining tolerances and molding techniques result in inconsistent disposition of the bar or rod in the groove or channel. Even though these types of prior art mounting devices may now have three point contact between the scope holding portion of the mounting device and the base, recoil of the firearm or jarring of the firearm can cause the bar or rod to shift in the channel or groove, skewing the scope holding portion of the mounting device and causing mis-alignment of the scope. Also, if the scope holding portion is removed from the base and then re-mounted on the base, mis-alignment still occurs because the bar or rod cannot be replaced in the groove or channel in exactly the same original position on the base before its removal. Again, any variance in the remounting of the scope holding portion on the base requires the scope to be re-sighted or re-zeroed. As before, poor machining tolerances and molding techniques often amplify the problem of having to re-sight a scope after re-mounting the scope holding portion of the device on the base of the device.

SUMMARY OF THE INVENTION

To overcome the before described considerations and problems inherent in and encountered with prior art scope mounting devices, there is provided by the subject invention a unique positive-aligning quick mount that aligns and positively re-aligns a prior art scope on a prior art firearm, such as a rifle, shotgun, black-powder weapon or handgun. The new and novel positive-aligning quick mount is also designed to be securely locked and unlocked without special tools, and further designed to quickly and easily connect and disconnect, allowing the user to quickly and easily remove a prior art scope from a prior art firearm.

The new and novel positive-aligning quick mount is comprised of three basic members. A base, which is attached to a gun receiver or other device, is designed to accept lower securing means, the lower securing means quickly and easily locking onto and unlocking from the base. Upper securing means is attached to the lower securing means and in conjunction with the lower securing means encompasses and secures a prior art sighting scope in the positive-aligning quick mount. The attached upper and lower securing means, encompassing a prior art sighting scope, are quickly and securely locked on the base and quickly unlocked from the base by rotatable locking means.

An engaging means is pivotally attached to a side of the lower securing means in an engaging means receptacle formed between a lower portion and an upper portion of the lower securing means. At least one tension means is seated in and protrudes from at least one tension means seat formed in the engaging means receptacle. The at least one tension means contacts and bears against a tension means surface formed on the engaging means, urging the engaging means to pivot outward, away from the lower securing means.

The rotatable locking means is rotatably attached to a threaded rotatable locking means shaft threadedly disposed through a threaded opening in the rotatable locking means, freely disposed through a bore formed through the engaging means and threadedly disposed in a threaded bore centrally formed in the recessed surface of the engaging means receptacle of the lower securing means. When the rotatable locking means is rotated around the threaded rotatable locking means shaft to an unlocked position, the rotatable locking means moves away from bearing means formed in the outer surface of the engaging means, allowing the at least one tension means to pivot the engaging means away from the lower securing means. When the rotatable locking means is rotated back to a locking position, the rotation of the rotatable locking means around the threaded shaft moves the rotatable locking means against the bearing means of the engaging means, pivoting the engaging means toward the lower securing means. Rotation of the rotatable locking means around the threaded shaft provides quick connecting and disconnecting of the lower securing means on and from the base of the positive-aligning quick mount.

Upper and lower base receiving surfaces, formed in the lower portions of the lower securing means and the engaging means, are designed to engage upper and lower base surfaces, formed on the sides of the base of the positive-aligning quick mount. An aligning means is disposed in an aligning means bore formed in the bottom surface of the lower securing means, the aligning means bore being centered between the front side and the back side of the lower securing means and intersecting the upper base receiving surface and the lower base receiving surface formed in the lower portion of the lower securing means.

At least one locating means, having a curved locating surface, is continuously formed in the sides of the base. The at least one locating means is oriented parallel to the top surface of the base so that the apex of the locating surface aligns with the intersection of the upper base surface and the lower base surface of the base and so that the locating surface is angled inward toward the center of at least one channel laterally formed in the top surface of the base of the positive-aligning quick mount. In the Preferred Embodiment, at least one locating means is continuously formed in the sides of the base on opposite sides of the at least one channel, the locating surface of each opposing at least one locating means being angled inward toward one another and toward the center of the at least one channel.

When the lower securing means is removably attached to the base, the aligning means disposed in the lower securing means docks with the at least one locating means formed in the base. Since opposing at least one locating means are continuously formed in the base in the Preferred Embodiment, four separate points of contact are achieved between the aligning means and opposing at least one locating means. Two contact points are achieved on the upper aligning surface of the aligning means and two contact points are achieved on the lower aligning surface of the aligning means. The resulting four point contact of the aligning means against opposing at least one locating means is extremely stable and allows the aligning means to positively re-align with the at least one locating means even after repeated removal of the aligning means from the at least one locating means and re-docking of the aligning means with the at least one locating means.

Once a prior art sighting scope is secured between the upper securing means and the lower securing means of the positive-aligning quick mount, the lower securing means is then seated on the base so that the aligning means contacts the at least one locating means and the engaging means is adjacent to a side of the base. The rotatable locking means is then rotated to a locking position pivoting the engaging means inward to engage the base.

Locking pressure of the rotatable locking means against the engaging means forces the upper base receiving surfaces and the lower base receiving surfaces of the lower securing means and the engaging means securely against the upper side base surfaces and the lower side base surfaces of the base, respectively, while simultaneously drawing the upper aligning surface and the lower aligning surface of the aligning means against the at least one locating means. The prior art sighting scope is now securely mounted on the prior art firearm.

Once the prior art sighting scope has been sighted in or zeroed, it can be quickly and easily removed from the prior art firearm by simply rotating the rotatable locking means to an unlocked position and removing the lower securing means from the base. The prior art firearm can now be repaired, cleaned or maintained without damaging the prior art sighting scope and the prior art sighting scope can be safely stored or transported off of the prior art firearm. When the prior art sighting scope, encompassed and secured by the lower securing means and the upper securing means, is subsequently re-installed on the prior art firearm, the at least one locating means is automatically positively and precisely re-aligned in the groove of the aligning means in exactly the same aligned position it was in before removal. Thus, the prior art sighting scope is exactly and precisely re-aligned in the same position it was in before removal from the prior art firearm, eliminating the need to re-sight the prior art sighting scope on the prior art firearm.

To achieve the foregoing and other advantages, the present invention provides a new and novel positive-aligning quick mount that positively and precisely re-aligns a zeroed prior art sighting scope on a prior art firearm, quickly and easily connects and disconnects, can be securely locked in place and is easily installed and removed.

The more important features of the present invention have been broadly outlined in order that the detailed description thereof that follows may be better understood and in order that the present contribution to the art may be better appreciated. There are additional features of the invention that will be more fully described hereinafter and which, together with the features outlined above, will form the subject matter of the claims appended hereto. Those skilled in the art will appreciate that the conception, upon which the present disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory review the nature and essence of the technical disclosure of the application. The abstract is neither intended to define the invention of the application, which is measured by the claims, nor is it intended to be limiting as to the scope of the invention in any way.

Accordingly, it is an object and advantage of the invention to provide a new and novel positive-aligning quick mount that positively and precisely re-aligns a zeroed sighting scope on a firearm.

Another object and advantage of the invention is to provide a new and novel positive-aligning quick mount that may be used with a variety of sighting scopes.

Another object and advantage of the invention is to provide a new and novel positive-aligning quick mount that securely locks in place.

Another object and advantage of the invention is to provide a new and novel positive-aligning quick mount that quickly and easily connects and disconnects.

Another object and advantage of the invention is to provide a new and novel positive-aligning quick mount that is easily installed and removed.

Still another object and advantage of the invention is to provide a new and novel positive-aligning quick mount which may be easily and efficiently manufactured and marketed.

Yet another object and advantage of the invention is to provide a new and novel positive-aligning quick mount which is of durable and reliable construction.

These and other objects and advantages will become apparent from review of the drawings and from a study of the Description of the Preferred Embodiment relating to the drawings which has been provided by way of illustration only.

DESCRIPTION OF THE PREFERRED EMBODIMENT

Figure 1:
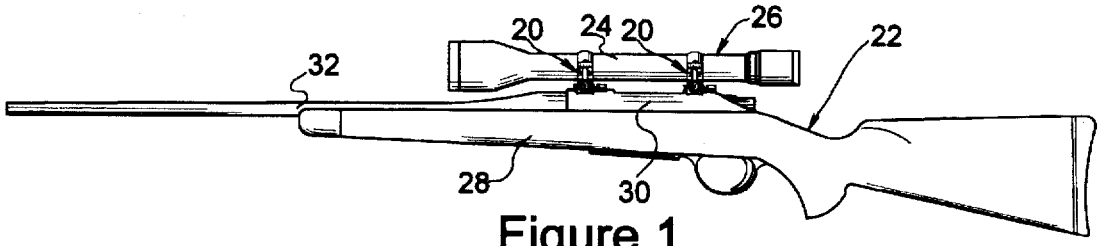
FIG. 1 is a side view of the new and novel positive-aligning quick mount in position on a prior art firearm.

Referring to the drawings in general, the present description is given in the context of the new and novel positive-aligning quick mount as utilized with a prior art firearm. It will be readily apparent to those skilled in the art that the usefulness of the present invention is not limited to this application and that changes could be made in construction and should be considered to be within the spirit and scope of the present invention.

Referring now in particular to FIG. 1 of the drawings, there is shown a new and novel positive-aligning quick mount, shown generally by the numeral 20, in position on a prior art firearm, shown generally by the numeral 22, the positive-aligning quick mount 20 removably encompassing and securing scope body 24 of a prior art sighting scope, shown generally by the numeral 26. Two positive-aligning quick mounts 20 are illustrated in FIG. 1, the two positive-aligning quick mounts 20 removably encompassing and positioning the prior art sighting scope 26 on the prior art firearm 22. A typical prior art firearm 22 has a stock 28, a receiver 30, and a barrel 32. The prior art firearm 22 and prior art sighting scope 26 are shown in the Preferred Embodiment and in FIG. 1 of the drawings for purposes of illustration only. The new and novel positive-aligning quick mount 20 has been designed to be utilized with a variety of prior art firearms such as rifles, shotguns, black-powder weapons, handguns and other firearms, as well as a variety of types and sizes of prior art sighting scopes.

Figure 2:
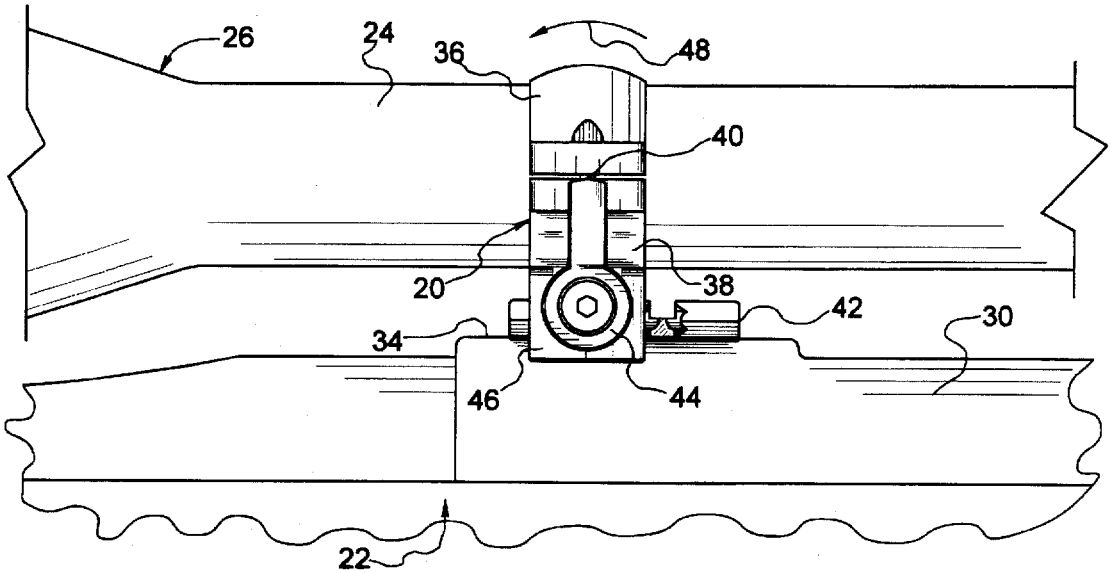
FIG. 2 is an enlarged side view of the new and novel positive-aligning quick mount in position on a prior art firearm.

Referring now to FIG. 2 of the drawings there is shown an enlarged side view of the positive-aligning quick mount 20 attached to top surface 34 of receiver 30 of a prior art firearm 22, the positive-aligning quick mount 20 removably encompassing the body 24 of a prior art sighting scope 26. Only a portion of the receiver 30, the prior art firearm 22 and the prior art sighting scope 26 is shown in FIG. 2 of the drawings for purposes of clarity.

Upper securing means 36 is removably attached to lower securing means 38, the upper securing means 36 and the lower securing means 38 removably encompassing, securing and positioning a prior art sighting scope 26 on a prior art firearm 22. The upper securing means 36 is removably attached to the lower securing means 38 by attaching means 40. In the Preferred Embodiment, the attaching means 40 is an allen head screw and will be shown and described more fully hereinafter. Other attaching means known in the art may also be used and are considered to be within the spirit and scope of the present invention. Also in the Preferred Embodiment, the upper securing means 36 and the lower securing means 38 are constructed from a rigid, non-flexing material such as steel, hardened steel, stainless steel or other rigid metal alloys, the upper securing means 36 and the lower securing means 38 being formed by machining or metal injection molding. Other rigid non-flexing materials and other methods of metal formation known in the art may also be used and are considered to be within the spirit and scope of the present invention.

A base 42, is attached to the top surface 34 of the receiver 30 of the prior art firearm 22. The base 42 is removably attached to the receiver 30 by attaching means 40, the attaching means 40 that attach the base 42 to the receiver 30 cannot be seen in FIG. 2, but are clearly shown in FIG. 5 of the drawings and will be discussed more fully hereinafter. Still referring to FIG. 2 of the drawings, rotatable locking means 44 removably locks engaging means 46 of the lower securing means 38 on the base 42. In FIG. 2 of the drawings, the rotatable locking means 44 is shown in a locking position. Rotation of the rotatable locking means 44 in the direction of the arrow 48 unlocks the engaging means 46 from the base 42 and allows the lower securing means 38 of the positive-aligning quick mount 20 to be removed from the base 42 of the positive-aligning quick mount 20. The removable attachment of the lower securing means 38 to the base 42 will be shown and described more fully hereinafter.

In the Preferred Embodiment and in the drawings, the rotatable locking means 44 is a threaded lever. Other rotatable locking means, such as a threaded thumb wheel, wing nut and similar threaded rotatable locking means known in the art may also be used and are considered to be within the spirit and scope of the present invention. Also in the Preferred Embodiment, the base 42 is constructed from a rigid, non-flexing material such as steel, hardened steel, stainless steel or other rigid metal alloys, the base 42 being formed by machining, powder metal pressing or metal injection molding. Other rigid non-flexing materials and other methods of metal formation known in the art may also be used and are considered to be within the spirit and scope of the present invention.

Figure 3:
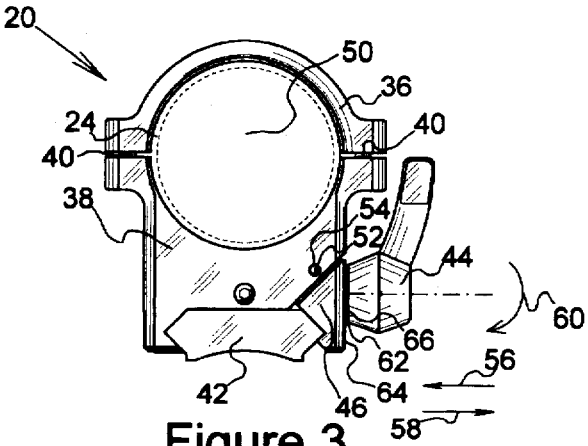
FIG. 3 is an end view of the positive-aligning quick mount removed from a prior art firearm.

Referring now to FIG. 3 of the drawings, there is shown an end view of the positive-aligning quick mount 20 removed from a prior art firearm. Attachment of the upper securing means 36 to the lower securing means 38 by attaching means 40 creates an opening 50 in which the body 24 of a prior art sighting scope 26 is disposed, the attachment of the upper securing means 36 to the lower securing means 38 designed to encompass and secure the body 24 of a prior art sighting scope 26. The body 24 of a prior art sighting scope 26 is shown in dashed lines in FIG. 3 of the drawings for purposes of clarity.

Pivot means 52 is disposed through retaining bore 54, the retaining bore 54 being formed through the lower securing means 38. The pivot means 52 allows the engaging means 46 to pivot in the direction of arrow 56 when the rotatable locking means 44 is rotated to a locking position, as shown in FIG. 3, and to pivot in the direction of arrow 58 when the rotatable locking means 44 is rotated to an unlocked position. Thus, the engaging means 46 pivots on the pivot means 52 to removably engage the base 42.

When the rotatable locking means 44 is rotated to lock or to unlock the engaging means 46, a twisting force is created generally in the direction of the arrow 60. Bearing means 62 is designed to abate this twisting force. In the Preferred Embodiment, the bearing means 62 is a semispherical protuberance continuously formed on outer surface 64 of the engaging means 46. The bearing means 62 is positioned to contact inner surface 66 of the rotatable locking means 44 below a central horizontal axis of the rotatable locking means 44, the central horizontal axis of the rotatable locking means 44 shown as a dot-dashed line in FIG. 3 of the drawings for purposes of clarity. In another embodiment, the bearing means 62 is a ball bearing partially embedded in the outer surface 64 of the engaging means 46. Other bearing means known in the art may also be used and are considered to be within the spirit and scope of the present invention.

Figure 4:
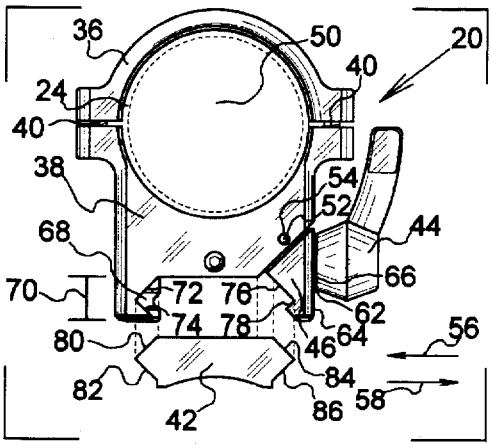
FIG. 4 is an end view of the positive-aligning quick mount, similar to FIG. 3, showing the lower securing means removed from the base.

Referring now to FIG. 4 of the drawings, there is shown an end view of the positive-aligning quick mount 20, similar to FIG. 3 of the drawings, the lower securing means 38 having been removed from the base 42. Aligning means 68 is centrally disposed in lower portion 70 of the lower securing means 38 opposite the engaging means 46. Upper base receiving surface 72 and lower base receiving surface 74 are formed in the lower portion 70 of the lower securing means 38 and oriented toward the engaging means 46, the upper base receiving surface 72 being angled upward and the lower base receiving surface 74 being angled downward, the upper base receiving surface 72 and the lower base receiving surface 74 intersecting to create an open angle oriented toward the engaging means 46. Upper base receiving surface 76 and lower base receiving surface 78 are similarly and oppositely formed on the engaging means 46, the base receiving surfaces 76 and 78 being formed on the engaging means 46 opposite the outer surface 64 of the engaging means 46, the open angle formed by the intersection of the upper base receiving surface 76 and the lower base receiving surface 78 oriented toward the base receiving surfaces 72 and 74 formed in the lower portion 70 of the lower securing means 38. The base receiving surfaces 72, 74, 76 and 78 are designed to mate with upper first side base surface 80, lower first side base surface 82, upper second side base surface 84 and lower second side base surface 86, respectively, when the lower securing means 38 is in a locking position on the base 42 as shown in FIG. 2 of the drawings.

Figure 5:
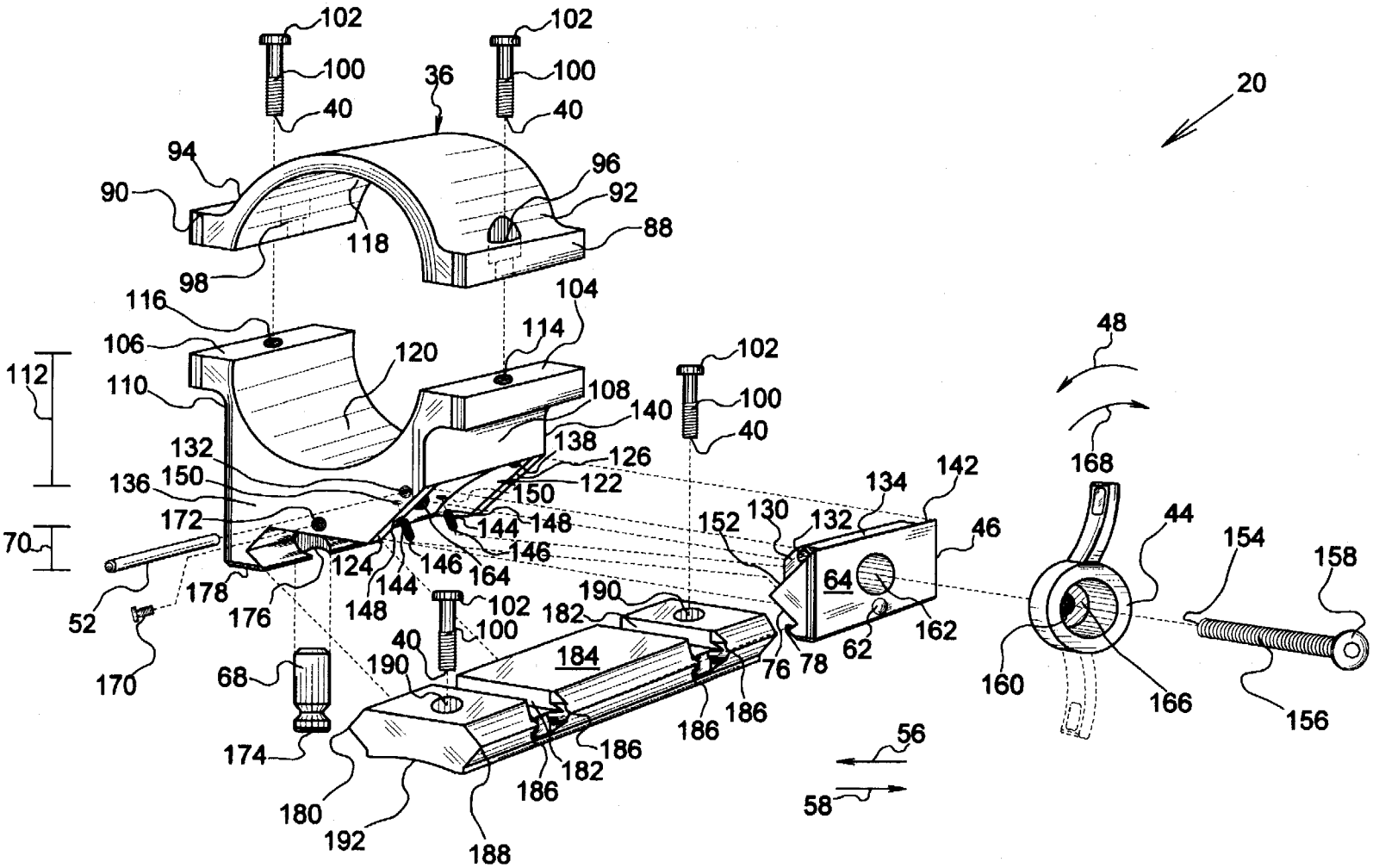
FIG. 5 is an exploded perspective view of the new and novel positive-aligning quick mount.

Referring now to FIG. 5 of the drawings, there will be described in detail the new and novel positive-aligning quick mount 20. FIG. 5 is an exploded perspective view of the new and novel positive-aligning quick mount 20. Arms 88 and 90 are formed on side 92 and opposite side 94, respectively, of the upper securing means 36. Attaching means bores 96 and 98 are centrally disposed through the arms 88 and 90, respectively, the attaching means bores 96 and 98 being shown in dashed lines in FIG. 5 for purposes of clarity. In the Preferred Embodiment, the attaching means bores 96 and 98 are recessed bores designed to allow shaft 100 of an attaching means 40 to pass through arms 88 and 90, respectively. The recessed attaching means bores 96 and 98 are further designed to prevent head 102 of an attaching means 40 from passing through the arms 88 and 90, respectively, the head 102 of an attaching means 40 being retained in the recessed portion of the attaching means bores 96 and 98.

Arms 104 and 106 are similarly formed on side 108 and opposite side 110, respectively, in upper portion 112 of the lower securing means 38, the arms 104 and 106 designed to mate with the arms 88 and 90, respectively, of the upper securing means 36. Threaded bores 114 and 116 are centrally formed in the arms 104 and 108, respectively, of the lower securing means 38. The threaded bores 114 and 116 are designed to align with the attaching means bores 96 and 98 of the arms 88 and 90, respectively, and are further designed to accept and retain a threaded portion of shaft 100 of an attaching means 40. Thus, attaching means 40 are disposed through attaching means bores 96 and 98 and threaded into threaded bores 114 and 116, respectively, thereby removably attaching the upper securing means 36 to the lower securing means 38. In the Preferred Embodiment, the attaching means 40 is an allen head screw. Other attaching means and other attaching methods known in the art may also be used and are considered to be within the spirit and scope of the present invention.

The upper securing means 36 has a generally semi-circular shape forming upper cradle 118 centrally located between the attaching arms 88 and 90. Lower cradle 120 is similarly formed in lower securing means 38 between arms 104 and 106, the lower cradle 120 also being generally semi-circular in shape. The concavity of the upper cradle 118 is oriented away from the lower securing means 38 and the concavity of the lower cradle 120 is oriented away from the upper securing means 36. Thus, when the body 24 of a prior art sighting scope 26 is placed in the lower cradle 120, and the upper securing means 36 is removably attached to the lower securing means 38, the upper cradle 118 and the lower cradle 120 encompass and secure the prior art sighting scope 26 in the positive-aligning quick mount 20. The body 24 of a prior art sighting scope 26 and a prior art sighting scope 26 are not shown in FIG. 5 for purposes of clarity, but are clearly shown in FIGS. 1 and 2 of the drawings.

Still referring to FIG. 5 of the drawings, there is shown an engaging means receptacle 122 formed in side 108 of the lower securing means 38, between the lower portion 70 and the upper portion 112 of the lower securing means 38. The engaging means receptacle 122 has a side 124, an opposite side 126 and a recessed surface 128, the recessed surface 128 being curved or angled downwardly and into the lower securing means 38. The engaging means receptacle 122 is designed to accept upper body 130 of the engaging means 46, the upper body 130 continuously formed on the engaging means 46 opposite the outer surface 64 of the engaging means 46 and above the upper base receiving surface 76 of the engaging means 46. Pivot means bore 132 is laterally disposed through the upper body 130 of the engaging means 46 near top surface 134 of the upper body 130.

Retaining bore 54 is disposed through front side 136 of the lower securing means 38 below the upper portion 112 and near the side 108 of the lower securing means 38, the retaining bore 54 opening into the engaging means receptacle 122 through the side 124 of the engaging means receptacle 122. Retaining bore 138 is similarly disposed through back side 140 of the lower securing means 38 below the upper portion 112 and near the side 108 of the lower securing means 38, the retaining bore 138 opening into the engaging means receptacle 122 through the opposite side 126 of the engaging means receptacle 122. Thus, the retaining bores 54 and 138 open into the uppermost portion of the engaging means receptacle 122, so that the retaining bores 54 and 138 align with one another. The pivot means bore 132, laterally disposed through the upper body 130 of the engaging means 46, is designed to align with the retaining bores 54 and 138 when the upper body 130 of the engaging means 46 is inserted into the engaging means receptacle 122.

Once the upper body 130 of the engaging means 46 has been inserted into the engaging means receptacle 122, and the pivot means bore 132 aligned with the retaining bores 54 and 138, the pivot means 52 is then disposed through the retaining bore 54, through the pivot means bore 132 and finally through the retaining bore 138. The pivot means 52 is designed to be interference press fitted in the retaining bores 54 and 138. That is, the diameter of the pivot means 52 is up to five-thousands of an inch larger than the diameter of the retaining bores 54 and 138 so that the pivot means 52 is tightly held in the retaining bores 54 and 138 after the pivot means 52 has been pressed into the retaining bores 54 and 138. The diameter of the pivot means bore 132 is designed to be slightly larger than the diameter of the pivot means 52 so that the upper body 130 of the engaging means 46 pivots on the pivot means 52 within the engaging means receptacle 122. The upper body 130 of the engaging means 46 is held within the engaging means receptacle 122 by the pivot means 52 so that the upper body 130 of the engaging means 46 does not contact the side 124, the opposite side 126 or the recessed surface 128 of the engaging means receptacle 122, the upper body 130 of the engaging means 46 freely pivoting on the pivot means 52 within the engaging means receptacle 122. Pivotal movement of the engaging means 46 in the direction of the arrow 58 is limited by the rotatable locking means 44 and by contact of top surface 142 of the engaging means 46 against the side 108 of the lower securing means 38, the top surface 142 of the engaging means 46 being slightly above the top surface 134 of the upper body 130 of the engaging means 46.

At least one tension means 144, having an end 146 and an opposite end 148, is seated in at least one tension means seat 150 formed in the recessed surface 128 of the engaging means receptacle 122, one of the at least one tension means seat 150 being formed the near side 124 of the engaging means receptacle 122 and another of the at least one tension means seat 150 being formed near the opposite side 126 of the engaging means receptacle 122. In the Preferred Embodiment and in FIG. 5 of the drawings, two at least one tension means 144 and two at least one tension means seat 150 are shown. One of the two at least one tension means seat 150 is illustrated in dashed lines in FIG. 5 for purposes of clarity. The opposite end 148 of the at least one tension means 144 is seated in the at least one tension means seat 150, the end 146 of the at least one tension means 144 protruding from the at least one tension means seat 150. Once the engaging means 46 is pivotally attached to the lower securing means 38 by the pivot means 52, as previously described, the end 146 of the at least one tension means 144 contacts and bears against tension means surface 156 formed on the engaging means 46, urging the engaging means 46 in the direction of the arrow 58. In the Preferred Embodiment, the tension means surface 152 is an angled surface formed adjacent to and on either side of the upper body 130 of the engaging means 46, the tension means surface 152 being downwardly angled from the top surface 142 of the engaging means 46 toward and intersecting the upper base receiving surface 76 of the engaging means 46. Also in the Preferred Embodiment and in FIG. 5 of the drawings, the at least one tension means 144 is a spring, the opposite end 148 of the at least one tension means 144 being held in the at least one tension means seat 150 by the limited movement of the engaging means 46, as previously described, and the inherent outward pressure of the at least one tension means 144 against the tension means surface 152 of the engaging means 46. In another embodiment, the opposite end 148 of the at least one tension means 144 is secured in the at least one tension means seat 150 with a metal adhesive. Other tension means and other securing methods known in the art may also be used and are considered to be within the spirit and scope of the present invention.

A locking means shaft, shown generally by the numeral 154 and having a threaded portion 156 and a head 158, is threadedly disposed through threaded opening 160 of the rotatable locking means 44, freely disposed through bore 162 formed through the engaging means 46 and threadedly disposed in threaded bore 164 centrally formed in the recessed surface 128 of the engaging means receptacle 122 of the lower securing means 38. The bore 162 of the engaging means 46 is centrally formed through the engaging means 46 between the bearing means 62 and the top surface 142 of the engaging means 46, and is designed to allow the engaging means 46 to move freely about the threaded portion 156 of the locking means shaft 154 and further designed to prevent contact of the engaging means 46 with the locking means shaft 154 when the engaging means 46 is pivoted on the pivot means 152. The threaded bore 164 is centrally formed through the recessed surface 128 of the engaging means receptacle 122, in the lower securing means 38, between the side 124 and the opposite side 126 of the engaging means receptacle 122.

The locking means shaft 154 is threadedly disposed in the threaded bore 164 of the lower securing means 38 so that the head 158 of the locking means shaft 154 does not contact recessed limiting surface 166, formed around the threaded opening 160 of the rotatable locking means 44, when the rotatable locking means 44 is in a locking position as shown in FIG. 5. When the rotatable locking means 44 is rotated around the threaded portion 156 of the shaft 154 in the direction of the arrow 48 to an unlocked position, as indicated by dashed lines in FIG. 5 of the drawings for purposes of clarity, the rotatable locking means 44 moves away from the bearing means 62 of the engaging means 46 allowing the engaging means 46 to pivot away from the base 42 in the direction of the arrow 58. The limiting surface 166 of the rotatable locking means 44 contacts the head 158 of the locking means shaft 154 when the rotatable locking means 44 is in an unlocked position, the locking means shaft 154 thereby limiting the outward travel of the rotatable locking means 44 and the pivotal movement of the engaging means 46 away from the lower securing means 38, the engaging means 46 being urged away from the lower securing means 38 by the at least one tension means 144 as previously described. When the rotatable locking means 44 is rotated back in the direction of the arrow 168 to a locking position, the rotation of the rotatable locking means 44 around the threaded portion 156 of the locking means shaft 154 moves the rotatable locking means 44 away from the head 158 of the locking means shaft 154 and against the bearing means 62 of the engaging means 46, pivoting the engaging means 46 inward to engage the base 42 in the direction of the arrow 56. Thus, the locking means shaft 154 allows the lower securing means 38 to be quickly and easily connected to and disconnected from the base 42. In the Preferred Embodiment, the threaded portion 156 of the locking means shaft 154 is designed to have a fast pitch, moving the rotatable locking means 44 from a locking position to an unlocked position and back to a locking position with minimal rotation of the rotatable locking means 44 about the threaded portion 156 of the locking means shaft 154. Other thread pitches known in the art may also be used and are considered to be within the spirit and scope of the present invention.

The outward travel of the rotatable locking means 44 can be adjusted by threading the locking means shaft 154 further into or out of the threaded bore 164 in the lower securing means 38. The desired adjusted disposition of the locking means shaft 154 in the threaded bore 164 of the lower securing means 38 is then fixed by retaining means 170 threadedly disposed through threaded bore 172 formed in front side 136 of the lower securing means 38 perpendicular to and intersecting the threaded bore 164. The retaining means 170 contacts and retains the shaft 154 in the adjusted position in threaded bore 164. In the Preferred Embodiment and in FIG. 5, the retaining means 170 is a set screw. Other retaining means known in the art may also be used and are considered to be within the spirit and scope of the present invention.

Aligning means 68, having an end 174, is disposed in aligning means bore 176 formed in bottom surface 178 of the lower securing means 38, the aligning means bore 176 centered between the front side 136 and the back side 140 of the lower securing means 38 and intersecting the upper base receiving surface 72 and the lower base receiving surface 74 of the lower securing means 38. The aligning means 68 is cylindrical in shape and is interference press fitted, as previously described, in the aligning means bore 176 so that the end 174 of the aligning means 68 is flush with the bottom surface 178 of the lower securing means 38. When the lower securing means 38 is positioned on the base 42, the aligning means 68 docks with at least one locating means continuously formed in first side 180 of the base 42 and adjacent to at least one channel 182 laterally formed in top surface 184 of the base 42. The at least one locating means continuously formed in the first side 180 of the base 42 cannot be seen in FIG. 5 of the drawings, but is a mirror image of the at least one locating means, shown generally by the numeral 186, continuously formed in second side 188 of the base 42. In the Preferred Embodiment, there two spaced apart at least one channels 182 formed in the top surface 184 of the base 42 and two at least one locating means 186 continuously formed adjacent to and on either side of each spaced apart at least one channel 182. Docking of the aligning means 68 with the at least one locating means 182 will be described more fully hereinafter.

The at least one channel 182 laterally formed in top surface 184 of the base 42 is designed to accept a locating bar or rod that may be present on prior art mounting devices. Thus, the base 42 of the new and novel positive-aligning quick mount 20 can be utilized with other prior art mounting devices, eliminating the need to remove the base 42 of the new and novel positive-aligning quick mount from a prior art firearm 22 if a prior art mounting device should be temporarily used on a prior art firearm 22. A prior art mounting device is not illustrated in the drawings and the prior art firearm 22 is not shown in FIG. 5 for purposes of clarity, the prior art firearm 22 clearly shown in FIG. 1 of the drawings.

Still referring to FIG. 5 of the drawings, at least one attaching means bore 190 is disposed through top surface 184 of the base 42. In the Preferred Embodiment, the at least one attaching means bore 190 is a recessed bore, similar to attaching means bores 96 and 98, designed to allow shaft 100 of an attaching means 40 to pass through the base 42. The recessed at least one attaching means bore 190 is further designed to prevent head 102 of an attaching means 40 from passing through the base 42, the head 102 of an attaching means 40 being retained in a recessed portion of the at least one attaching means bore 190. Additionally, bottom surface 192 of the base 42 is curved, the bottom surface 192 designed to mate with the top surface 34 of the receiver 30 of a prior art firearm 22. Thus, attaching means 40 is used to attach the base 42 to the top surface 34 of the receiver 30 of a prior art firearm 22, the receiver 30 and the prior art firearm 22 not shown in FIG. 5 for purposes of clarity, but clearly seen in FIGS. 1 and 2 of the drawings.

Figure 6:
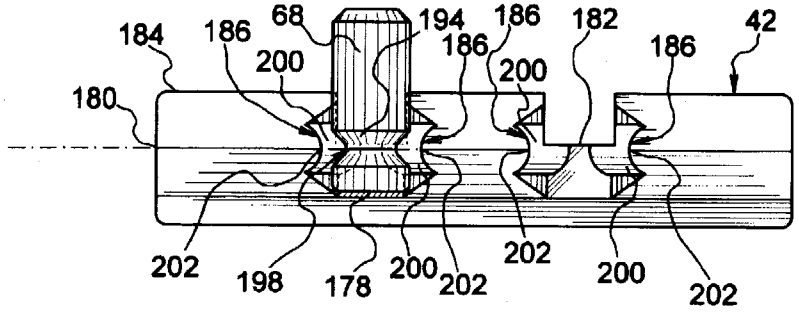
FIG. 6 is a side view of aligning means of the new and novel positive-aligning quick mount in a docked position on the base of the positive-aligning quick mount.

Referring now to FIG. 6 of the drawings, there is shown a side view of the aligning means 68 in a docked position on at least one locating means 186 continuously formed in the first side 180 of the base 42. Hidden portions of two at least one locating means 186 and one at least one channel 182, laterally formed in the top surface 184 of the base 42, are shown is dashed lines in FIG. 6 of the drawings, for purposes of clarity. FIG. 6 of the drawings also shows two unencumbered at least one locating means 186 also formed in the first side 180 of the base 42 for purposes of clarity.

Upper aligning surface 194 and lower aligning surface 196 are continuously formed near the bottom surface 178 of the aligning means 68, the upper aligning surface 194 and the lower aligning surface 196 being oppositely angled inward toward a lateral axis of the aligning means 68, creating a groove 198 in the circumference around the aligning means 68. The lateral axis of the aligning means 68 is shown in a dot-dashed line in FIG. 6 of the drawings for purposes of clarity. Referring briefly back to FIG. 5 of the drawings, it can be seen that the aligning means 68 intersects the upper base receiving surface 72 and the lower base receiving surface 74 so that a portion of the upper aligning surface 194 and the lower aligning surface 196 of the aligning means 68 is exposed by the open angle created by the upper base receiving surface 72 and the lower base receiving surface 74 of the lower securing means 38. The exposed portion of the aligning means 68 in the open angle created by the upper base receiving surface 72 and the lower base receiving surface 74 is oriented toward the engaging means 46 of the lower securing means 38.

Still referring to FIG. 6 of the drawings, there is shown at least one locating means 186, having a curved locating surface 200, continuously formed in the first side 180 of the base 42, the locating surface 200 being generally semi-circular. The at least one locating means 186 is oriented parallel to the top surface 184 of the base 42 so that apex 202 of the locating surface 200 aligns with the intersection of the upper base surface 80 and the lower base surface 82 of the base 42 and so that the locating surface 200 is angled inward toward the center of the at least one channel 182. In the Preferred Embodiment, at least one locating means 186, oriented as described above, is continuously formed in the first side 180 of the base 42 on opposite sides of the at least one channel 182, the locating surface 200 of each opposing at least one locating means 186 being angled inward toward one another and toward the center of the at least one channel 182. The unencumbered at least one locating means 186 clearly illustrates this opposing configuration. Also in the Preferred Embodiment, opposing at least one locating means 186 are continuously formed adjacent to each spaced apart at least one channel 182, opposing at least one locating means 186 also being continuously formed in the second side 188 of the base 42 and being mirror images of the opposing at least one locating means 186 continuously formed in the first side 180 of the base 42. At least one locating means 186 continuously formed in the second side 188 of the base 42 cannot be seen in FIG. 6, but is clearly shown in FIG. 5 of the drawings. Formation of the at least one locating means 186 adjacent to spaced apart at least one channels 182, allows for diverse placement of the lower securing means 38 on the base 42, thereby allowing a prior art sighting scope 26 to be diversely positioned on a prior art firearm 22 as needed, the lower securing means 38, the prior art sighting scope 26 and the prior art firearm 22 not shown in FIG. 6, but clearly shown in FIGS. 1 of the drawings. Other sums of the at least one locating means 186 and the at least one channel 182 may also be used and are considered to be within the spirit and scope of the present invention.

Still referring to FIG. 6 of the drawings, when the aligning means 68 docks with the at least one locating means 186, the upper aligning surface 194 and the lower aligning surface 196 of the aligning means 68 contacts and is held against the locating surface 200 of the at least one locating means 186. The upper aligning surface 194 contacts the at least one locating means 186 above the apex 202 of the locating surface 200 and the lower aligning surface 196 contacts the at least one locating means 186 below the apex 202 of the locating surface 200. Since opposing at least one locating means 186 are continuously formed in the base 42 in the Preferred Embodiment, four separate points of contact are achieved between the aligning means 68 and opposing at least one locating means 186. Two contact points are achieved on the upper aligning surface 194 of the aligning means 68 and two contact points are achieved on the lower aligning surface 196 of the aligning means 68. The resulting four point contact of the aligning means 68 against opposing at least one locating means 186 is extremely stable and allows the aligning means 68 to positively re-align with the at least one locating means 186 even after repeated removal of the aligning means 68 from the at least one locating means 186 and re-docking of the aligning means 68 with the at least one locating means 186. That is, the curved nature of the locating surface 200 and the angled nature of the upper aligning surface 194 and the lower aligning surface 196 allows the aligning means 68 to align and precisely re-align with the at least one locating means 186.

Referring now to the drawings in general, when the body 24 of a prior art sighting scope 26 is placed in the lower cradle 120 of the lower securing means 38, and the upper securing means 36 is attached to the lower securing means 38, the upper cradle 118 of the upper securing means 36 and the lower cradle 120 of the lower securing means 38 encompass and secure the body 24 of the prior art sighting scope 26. The lower securing means 38 of the positive-aligning quick mount 20 is then removably attached to the base 42 of the positive-aligning quick mount 20. Thus, the new and novel positive-aligning quick mount 20 positions and orients the prior art sighting scope 26 on the prior art firearm 22. The prior art sighting scope 26 can now be sighted in. That is, the prior art sighting scope 26 can be adjusted for lateral accuracy, or windage, and for elevational accuracy, or elevation. The initial positioning of a prior art sighting scope 26 on a prior art firearm 22 affects these adjustments. It may become necessary to remove the prior art sighting scope 26 from the prior art firearm 22 after the scope has been sighted in. For example, it may be necessary to remove the prior art sighting scope 26 to access certain parts of the prior art firearm 22 that need repair, cleaning or other maintenance, or the prior art sighting scope 26 may removed for storage or transportation. The unique multiple contact point alignment employed by the new and novel positive-aligning quick mount 20 eliminates the need to re-sight the prior art sighting scope 26 if it has been removed from the prior art firearm 22 and then re-installed on the prior art firearm 22 utilizing the new and novel positive-aligning quick mount 20.

Figure 7:
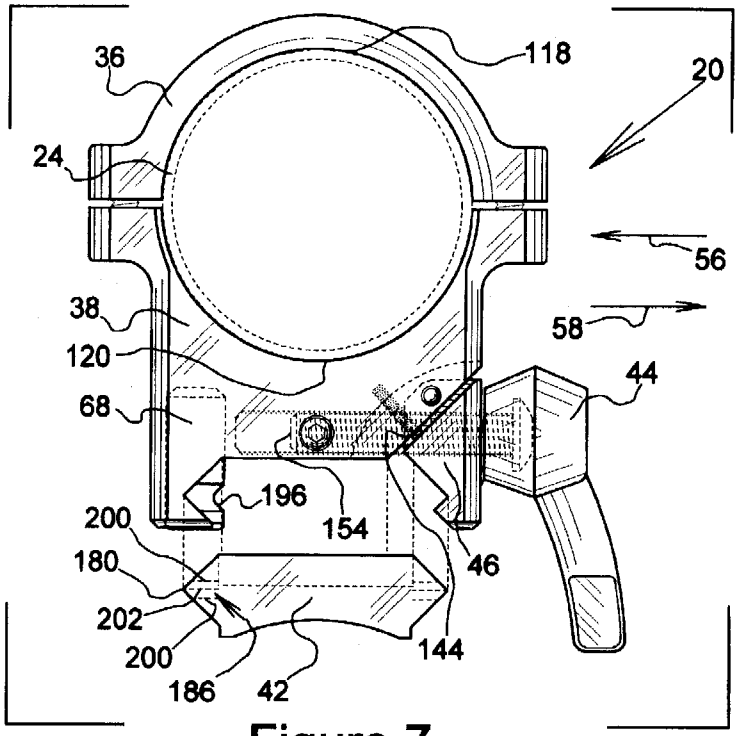
FIG. 7 is an end view of the new and novel positive-aligning quick mount, similar to FIG. 4, showing the lower securing means removed from the base.
Figure 8:
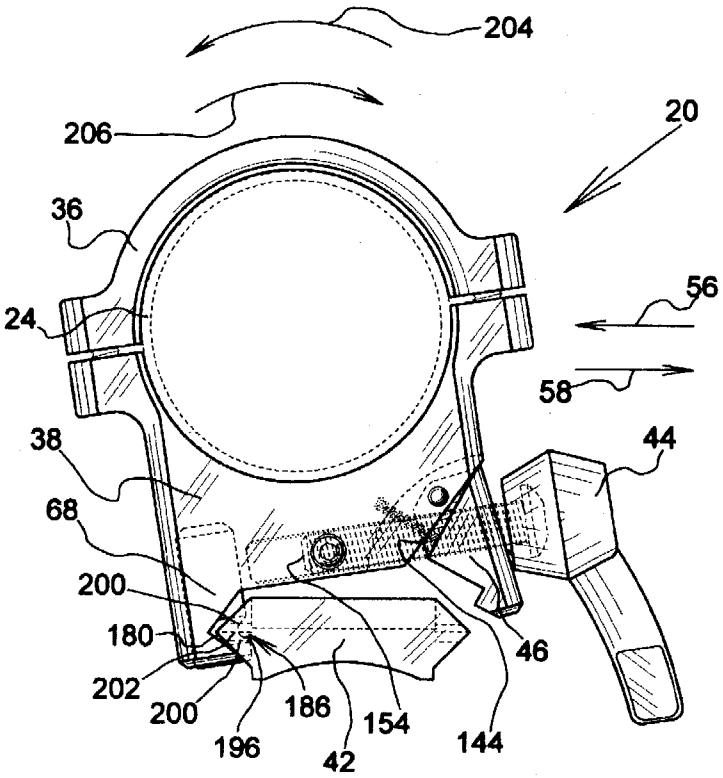
FIG. 8 is an end view of the new and novel positive-aligning quick mount showing the lower securing means partially positioned on the base.
Figure 9:
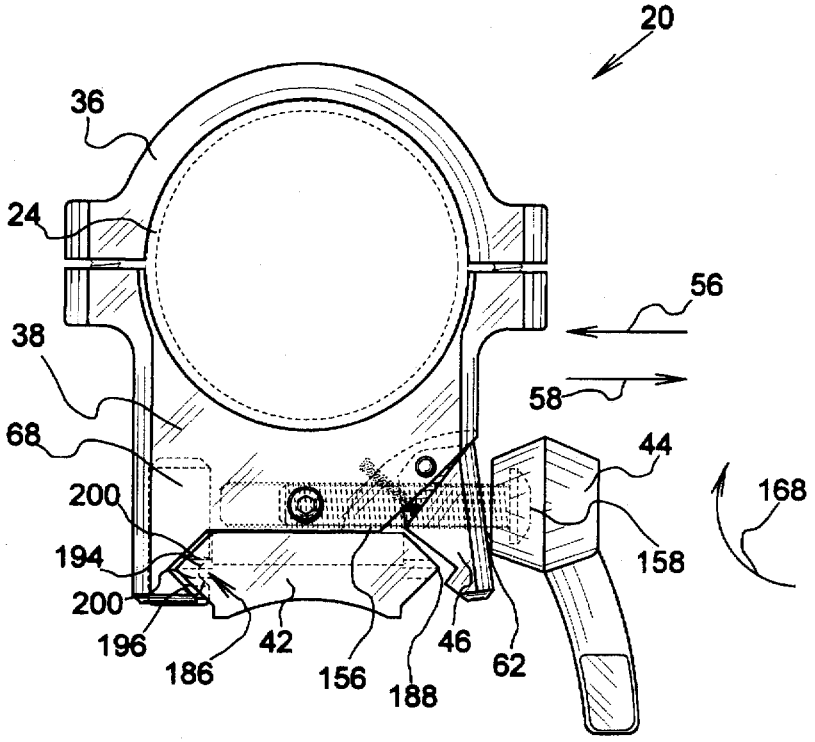
FIG. 9 is an end view of the new and novel positive-aligning quick mount in an unlocked position.
Figure 10:
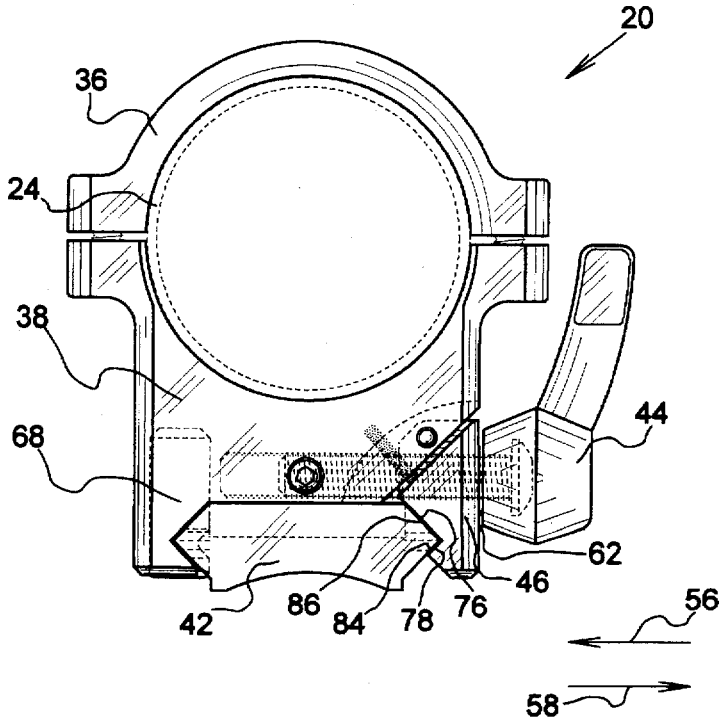
FIG. 10 is an end view of the new and novel positive-aligning quick mount in a locking position.

Referring now to FIGS. 7, 8, 9 and 10 of the drawings, there will be described the removable attachment of the lower securing means 38, with attached upper securing means 36, to the base 42 of the new and novel positive-aligning quick mount 20 and how the new and novel positive-aligning quick mount 20 aligns and positively re-aligns a prior art sighting scope 26 on a prior art firearm 22. FIG. 7 is an end view of the new and novel positive-aligning quick mount 20 showing the lower securing means 38 removed from the base 42. FIG. 8 is an end view of the new and novel positive-aligning quick mount 20 showing the lower securing means 38 partially positioned on the base 42. FIG. 9 is an end view of the new and novel positive-aligning quick mount 20 in an unlocked position. FIG. 10 is an end view of the new and novel positive-aligning quick mount 20 in a locking position. A prior art firearm 22 is not shown in FIGS. 7, 8, 9 and 10, and the body 24 of a prior art sighting scope 26 and hidden portions of the new and novel positive-aligning quick mount 20 are shown in dashed lines in FIGS. 7, 8, 9 and 10, for purposes of clarity.

Referring now in particular to FIG. 7 of the drawings, there is shown the lower securing means 38, with attached upper securing means 36, the lower securing means 38 removed from the base 42 of the new and novel positive-aligning quick mount 20. The body 24 of a prior art sighting scope 26 is encompassed and secured by the upper cradle 118 of the upper securing means 36 and the lower cradle 120 of the lower securing means 38, the body 24 of the prior art sighting scope 26 shown in dashed lines in FIG. 7 of the drawings for purposes of clarity. The rotatable locking means 44 is shown in an unlocked position. Since the at least one tension means 144 urges the engaging means 46 in the direction of the arrow 58, as previously described, the engaging means 46 is pivoted away from the lower securing means 38 and the lower securing means 38 can be removably attached to the base 42.

Referring now to FIG. 8 of the drawings, there is shown the lower securing means 38, with attached upper securing means 36 encompassing and securing a prior art sighting scope 26, the lower securing means 38 partially positioned on the base 42. The lower securing means 38 is tilted in the direction of the arrow 204 allowing the lower aligning surface 196 of the aligning means 68 to contact the at least one locating means 186 formed in the first side 180. The lower securing means 38 is then rotated downward in the direction of the arrow 206 seating the lower securing means 38 on the top surface 184 of the base 42, positioning the engaging means 46 adjacent to the second side 188 of the base 42 as shown in FIG. 9 of the drawings.

Referring now to FIG. 9 of the drawings, there is shown an end view of the new and novel positive-aligning quick mount 20 in an unlocked position. The engaging means 46 is in position adjacent to the second side 188 of the base 42, the upper aligning surface 194 and the lower aligning surface 196 of the aligning means 68 contacting the locating surface 200 of the at least one locating means 186. The rotatable locking means 44 is then rotated to a locking position in the direction of the arrow 168. Rotation of the rotatable locking means 44 around the locking means shaft 154, in the direction of the arrow 168, moves the rotatable locking means 44 against the bearing means 62 of the engaging means 46, pressing the engaging means 46 inward to engage the base 42 in the direction of the arrow 56.

Referring now to FIG. 10 of the drawings, there is shown an end view of the new and novel positive-aligning quick mount 20 in a locking position. Locking pressure of the rotatable locking means 44 against the bearing means 62 of the engaging means 46 forces the upper base receiving surface 76 and the lower base receiving surface 78 securely against the upper second side base surface 84 and the lower second side base surface 86 of the base 42, respectively, in the direction of the arrow 56. The locking pressure of the rotatable locking means 44 against the bearing means 62 of the engaging means 46 simultaneously draws the upper aligning surface 194 and the lower aligning surface 196 of the aligning means 68 against the at least one locating means. 186, and the upper base receiving surface 72 and the lower base receiving surface 74 of the lower securing means 38 against the upper first side base surface 80 and the lower first side base surface 82 of the base 42, respectively, thereby positively and precisely aligning the at least one locating means 186 in the groove 198 formed in and around the circumference of the aligning means 68. Thus, a prior art sighting scope 26 encompassed and secured by the new and novel positive-aligning quick mount 20 is positively and precisely aligned on a prior art firearm 22.

Once the prior art sighting scope 26 has been sighted or zeroed on a prior art firearm 22, it can be quickly and easily removed from the prior art firearm 22 by removing the lower securing means 38 from the base 42 by reversing the procedure described above. After the prior art sighting scope 26 has been removed from the prior art firearm 22, the prior art firearm 22 can be repaired, cleaned or maintained without damaging the prior art sighting scope 26. The prior art sighting scope 26 can also be safely stored or transported off of the prior art firearm 22. When the prior art sighting scope 26, encompassed and secured by the lower securing means 38 and the upper securing means 36 of the new and novel positive-aligning quick mount 20, is subsequently re-installed on the prior art firearm 22, the at least one locating means 186 is automatically positively and precisely re-aligned in the groove 198 of the aligning means 68 in exactly the same aligned position it was in before removal. Thus, the prior art sighting scope 26 is exactly and precisely re-aligned in the same position it was in before removal from the prior art firearm 22, eliminating the need to re-sight the prior art sighting scope 26 on the prior art firearm 22.

From the above it can be seen that the new and novel positive-aligning quick mount accomplishes all of the objects and advantages presented herein before. Nevertheless it is within the spirit and scope of the invention that changes in the basic positive-aligning quick mount may be made and the Preferred Embodiment and the modifications shown and described herein have only been given by way of illustration.

Having described my invention, I claim:

1. A positive-aligning quick mount for removable attachment to a prior art firearm, the prior art firearm having a receiver with a top surface, the positive-aligning quick mount removably engaging a prior art sighting scope, the prior art sighting scope having a body, the positive-aligning quick mount comprising:

a. upper securing means having a centrally located upper cradle;

b. lower securing means having a side, an opposite side, a lower portion, a bottom surface and a lower cradle, the lower securing means removably attached to the upper securing means, wherein the upper cradle and the lower cradle encompass and secure the body of the prior art sighting scope;

c. an engaging means receptacle formed in the side of the lower securing means;

d. an engaging means pivotally attached in the engaging means receptacle, the engaging means having an outer surface;

e. a locking means shaft centrally threadedly disposed in the engaging means receptacle and centrally freely disposed through the engaging means;

f. rotatable locking means rotatably attached to the locking means shaft adjacent to the outer surface of the engaging means, the rotatable locking means being rotatable around the locking means shaft, wherein the rotatable locking means bears against the outer surface of the engaging means when rotated toward the engaging means;

g. aligning means having a groove formed therein, a circumference and a bottom surface, the aligning means centrally disposed in the bottom surface of the lower securing means;

h. a base having a first side, a second side and a top surface, the base removably attached to the lower securing means, and;

i. at least one locating means formed in the first side of the base, wherein the at least one locating means is aligned in the groove formed in the aligning means when the base is removably attached to the lower securing means.

2. The positive-aligning quick mount as defined in claim 1 wherein base receiving surfaces are formed in the engaging means, the base receiving surfaces engaging the second side of the base.

3. The positive-aligning quick mount as defined in claim 1 wherein at least one channel is laterally formed in the top surface of the base.

4. The positive-aligning quick mount as defined in claim 1 wherein base receiving surfaces are formed in the lower portion of the lower securing means, the base receiving surfaces intersecting and forming an open angle oriented toward the engaging means, the base receiving surfaces engaging the first side of the base.

5. The positive-aligning quick mount as defined in claim 4 wherein the groove is continuously formed in the circumference around the aligning means near the bottom surface of the aligning means, the groove further comprised of an upper aligning surface and a lower aligning surface, the upper aligning surface and the lower aligning surface being oppositely angled inward and intersecting, the aligning means being disposed in the bottom surface of the lower securing means and intersecting the base receiving surfaces, a portion of the upper aligning surface and a portion of the lower aligning surface exposed by the open angle of the base receiving means.

6. The positive-aligning quick mount as defined in claim 5 wherein the at least one locating means has a locating surface formed thereon, the locating surface being curved and having an apex, the at least one locating means oriented parallel to the top surface of the base and angled inward, the upper aligning surface contacting the locating surface above the apex and the lower aligning surface contacting the apex below the apex.

7. The positive-aligning quick mount as defined in claim 6 wherein opposing at least one locating means are formed in the first side of the base and oriented parallel to the top surface of the base, the opposing at least one locating means angled inward toward one another, the upper aligning surface contacting each opposing at least one locating means on the locating surface above the apex and the lower aligning surface contacting each opposing at least one locating means on the locating surface below the apex.

8. A positive-aligning quick mount for removable attachment to a prior art firearm, the prior art firearm having a barrel and a receiver with a top surface, the positive-aligning quick mount removably engaging a prior art sighting scope, the prior art sighting scope having a body, the positive-aligning quick mount comprising:

a. a base having a first side, a second side, a top surface and a bottom surface, the base removably attached to the top surface of the receiver of a prior art firearm;

b. lower securing means having a side, an opposite side, a lower portion, a bottom surface and a lower cradle, the lower securing means removably attached to the base, wherein the lower securing means removably engages the first side and the second side of the base;

c. an engaging means receptacle formed in the side of the lower securing means;

d. an engaging means pivotally attached in the engaging means receptacle, the engaging means having an outer surface;

e. a locking means shaft centrally threadedly disposed in the engaging means receptacle and centrally freely disposed through the engaging means;

f. rotatable locking means rotatably attached to the locking means shaft adjacent to the outer surface of the engaging means, the rotatable locking means being rotatable around the locking means shaft, wherein the rotatable locking means bears against the outer surface of the engaging means when rotated toward the engaging means, the engaging means removably engaging the second side of the base;

g. aligning means having a groove formed therein, a circumference and a bottom surface, the aligning means centrally disposed in the bottom surface of the lower securing means;

h. at least one locating means formed in the first side and in the second side of the base, wherein the at least one locating means formed in the first side of the base is aligned in the groove formed in the aligning means when the base is removably attached to the lower securing means; and i. upper securing means having a centrally located upper cradle, the upper securing means removably attached to the lower securing means, wherein the upper cradle and the lower cradle of the lower securing means encompass and secure the body of the prior art sighting scope, the prior art sighting scope being positioned above the receiver and aligned with the barrel of the prior art firearm.

9. The positive-aligning quick mount as defined in claim 8 wherein base receiving surfaces are formed in the engaging means, the base receiving surfaces engaging the second side of the base.

10. The positive-aligning quick mount as defined in claim 8 wherein at least one channel is laterally formed in the top surface of the base.

11. The positive-aligning quick mount as defined in claim 8 wherein base receiving surfaces are formed in the lower portion of the lower securing means, the base receiving surfaces intersecting and forming an open angle oriented toward the engaging means, the base receiving surfaces engaging the first side of the base.

12. The positive-aligning quick mount as defined in claim 11 wherein the groove is continuously formed in the circumference around the aligning means near the bottom surface of the aligning means, the groove further comprised of an upper aligning surface and a lower aligning surface, the upper aligning surface and the lower aligning surface being oppositely angled inward and intersecting, the aligning means being disposed in the bottom surface of the lower securing means and intersecting the base receiving surfaces, a portion of the upper aligning surface and a portion of the lower aligning surface exposed by the open angle of the base receiving means.

13. The positive-aligning quick mount as defined in claim 12 wherein the at least one locating means has a locating surface formed thereon, the locating surface being curled and having an apex, the at least one locating means oriented parallel to the top surface of the base and angled inward, the upper aligning surface contacting the locating surface above the apex and the lower aligning surface contacting the apex below the apex.

14. The positive-aligning quick mount as defined in claim 13 wherein opposing at least one locating means are formed in the first side of the base and oriented parallel to the top surface of the base, the opposing at least one locating means angled inward toward one another, the upper aligning surface contacting each opposing at least one locating means on the locating surface above the apex and the lower aligning surface contacting each opposing at least one locating means on the locating surface below the apex.

15. A positive-aligning quick mount for removable attachment to a prior art firearm, the prior art firearm having a barrel and a receiver with a top surface, the positive-aligning quick mount removably engaging a prior art sighting scope, the prior art sighting scope having a body, the positive-aligning quick mount comprising:

a. lower securing means having a side, an opposite side, a lower portion, a bottom surface and a lower cradle;

b. upper securing means having a centrally located upper cradle, the upper securing means removably attached to the lower securing means, wherein the upper cradle and the lower cradle encompass and secure the body of the prior art sighting scope;

c. an engaging means receptacle formed in the side of the lower securing means;

d. an engaging means having an upper body and an outer surface, the upper body of the engaging means pivotally attached in the engaging means receptacle;

e. a locking means shaft centrally threadedly disposed in the engaging means receptacle and centrally freely disposed through the engaging means;

f. rotatable locking means rotatably attached to the locking means shaft adjacent to the outer surface of the engaging means, the rotatable locking means being rotatable around the locking means shaft, wherein the rotatable locking means bears against the outer surface of the engaging means when rotated toward the engaging means;

g. aligning means having a groove formed therein, a circumference and a bottom surface, the aligning means centrally disposed in the bottom surface of the lower securing means;

h. a base having a first side, a second side, a top surface and a bottom surface, the base bottom surface of the base removably attached to the top surface of the receiver of a prior art firearm; and i. at least one locating means formed in the first side and in the second side of the base, wherein the at least one locating means formed in the first side of the base is aligned in the groove formed in the aligning means when the base is removably attached to the lower securing means, the aligning means removably engaging the at least one locating means thereby positioning the prior art sighting in alignment with the barrel of the prior art firearm.

16. The positive-aligning quick mount as defined in claim 15 wherein base receiving surfaces are formed in the engaging means, the base receiving surfaces engaging the second side of the base.

17. The positive-aligning quick mount as defined in claim 15 wherein at least one channel is laterally formed in the top surface of the base.

18. The positive-aligning quick mount as defined in claim 15 wherein base receiving surfaces are formed in the lower portion of the lower securing means, the base receiving surfaces intersecting and forming an open angle oriented toward the engaging means, the base receiving surfaces engaging the first side of the base.

19. The positive-aligning quick mount as defined in claim 18 wherein the groove is continuously formed in the circumference around the aligning means near the bottom surface of the aligning means, the groove further comprised of an upper aligning surface and a lower aligning surface, the upper aligning surface and the lower aligning surface being oppositely angled inward and intersecting, the aligning means being disposed in the bottom surface of the lower securing means and intersecting the base receiving surfaces, a portion of the upper aligning surface and a portion of the lower aligning surface exposed by the open angle of the base receiving means.

20. The positive-aligning quick mount as defined in claim 19 wherein the at least one locating means has a locating surface formed thereon, the locating surface being curved and having an apex, the at least one locating means oriented parallel to the top surface of the base and angled inward, the upper aligning surface contacting the locating surface above the apex and the lower aligning surface contacting the apex below the apex.

21. The positive-aligning quick mount as defined in claim 20 wherein opposing at least one locating means are formed in the first side of the base and in the second side of the base, the opposing at least one locating means oriented parallel to the top surface of the base, the opposing at least one locating means angled inward toward one another, the upper aligning surface contacting each opposing at least one locating means on the locating surface above the apex and the lower aligning surface contacting each opposing at least one locating means on the locating surface below the apex.

* * * * *